United States Patent [19]

Sheppard

[11] Patent Number: 4,714,043

[45] Date of Patent: Dec. 22, 1987

[54] POWERED V-BERTH PLATFORM

[76] Inventor: William L. Sheppard, 36655 Romulus Rd., Romulus, Mich. 48174

[21] Appl. No.: 895,461

[22] Filed: Aug. 11, 1986

[51] Int. Cl.[4] ..... B63B 29/06; B63B 29/10

[52] U.S. Cl. ..... 114/343; 5/9 R; 5/11 B; 114/188; 114/363; 297/217; 297/347

[58] Field of Search ..... 105/316, 317; 114/343, 114/363, 188, 192; 5/2 R, 9 R, 118; 297/247, 338, 345, 347, 348, 118; 108/147; D12/300, 317

[56] References Cited

U.S. PATENT DOCUMENTS

| | | | |
|---|---|---|---|
| 1,569,249 | 1/1926 | Anthony | 114/193 |
| 1,676,108 | 7/1928 | Novak | 108/20 |
| 2,383,178 | 8/1945 | Edwards | 114/363 |
| 3,480,975 | 12/1969 | Racine et al. | 5/118 |
| 3,707,930 | 1/1973 | Yindra et al. | 108/147 |
| 3,738,699 | 6/1973 | Fain | 5/118 X |
| 3,880,458 | 4/1975 | Jackson | 296/23 |
| 3,908,565 | 9/1975 | Burnett | 108/147 |
| 4,279,398 | 7/1981 | Pregnall | 248/405 |
| 4,493,469 | 1/1985 | Holobaugh | 108/147 X |
| 4,567,845 | 2/1986 | Smith | 114/343 X |

*Primary Examiner*—Sherman D. Basinger

*Attorney, Agent, or Firm*—Harness, Dickey & Pierce

[57] ABSTRACT

There is disclosed a cushioned platform for filling in the gap in a V-berth platform in the bow of a boat or the like, and an apparatus for raising and lowering the platform between seating and sleeping positions.

14 Claims, 5 Drawing Figures

POWERED V-BERTH PLATFORM

BACKGROUND AND SUMMARY OF THE INVENTION

The present invention generally relates to platforms for bridging the cut away portion in a V-berth type bed in a boat, yacht, or the like, and more particularly to a motorized platform for bridging the cut away portion in a V-berth.

To maximize space, in the bow of boats or yachts a portion of the berth is cut away to form what is commonly known in the field as a V-berth. The cut away portion of the berth facilitates getting into the berth, as well as providing additional space for the sailor to carry on personal functions such as grooming and dressing.

Accordingly, it is an object of the present invention to overcome the disadvantages of the prior art. The present invention concerns the provisions of a motorized platform that moves from a lower, seating position to an upper, bridging, sleeping position occupying the gap or cut-away portion of the V-berth. When the platform is in its lower position, it is a functional and useful chair or stool (V-berths are normally disposed above standard chair height to take advantage of greater hull width). The present invention enables the sailor easy access to storage compartment underneath the V-berth while the motorized platform is in its lower position. Further, the present invention eliminates need for storage of the platform and the manual positioning and removing of same into and out of the cut-away portion of the V-berth. The invention permits the platform to be changed from its lower, chair position to its upper horizontal platform position by the touch of a switch.

From the subsequent description and the appended claims, taken in conjunction with the accompanying drawings, other objects and advantages of the present invention will become apparent to one skilled in the art.

DETAILED DESCRIPTION OF THE PREFERRED EMBODIMENT

Figure 1:
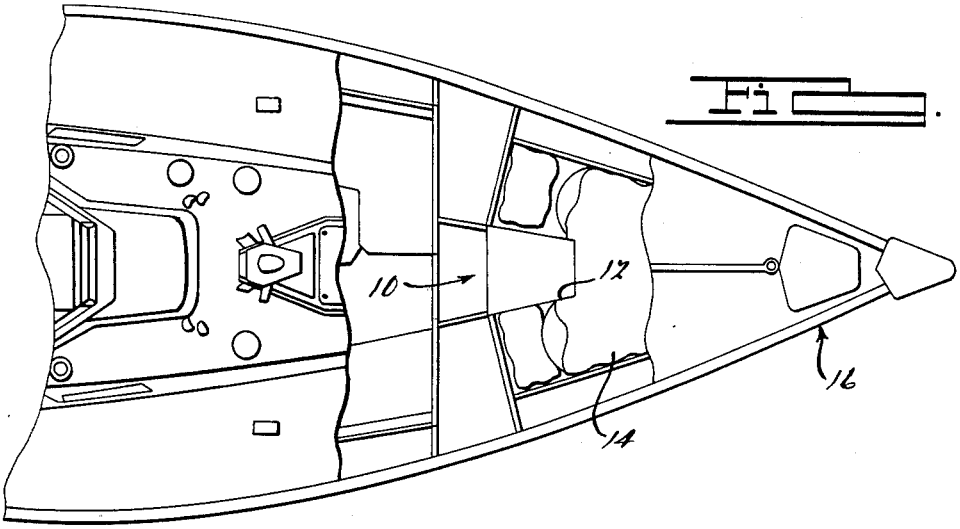
FIG. 1 is a cut away section of a bow of a boat illustrating a top plan view of a V-berth platform in accordance with the present invention.

Referring to the drawings, a motorized V-berth platform is shown, designated generally with the reference numeral 10. Best seen in FIG. 1, the V-berth platform 10 is positioned in the cut away portion of a V-berth 14 in the bow of a vessel 16.

Figure 3:
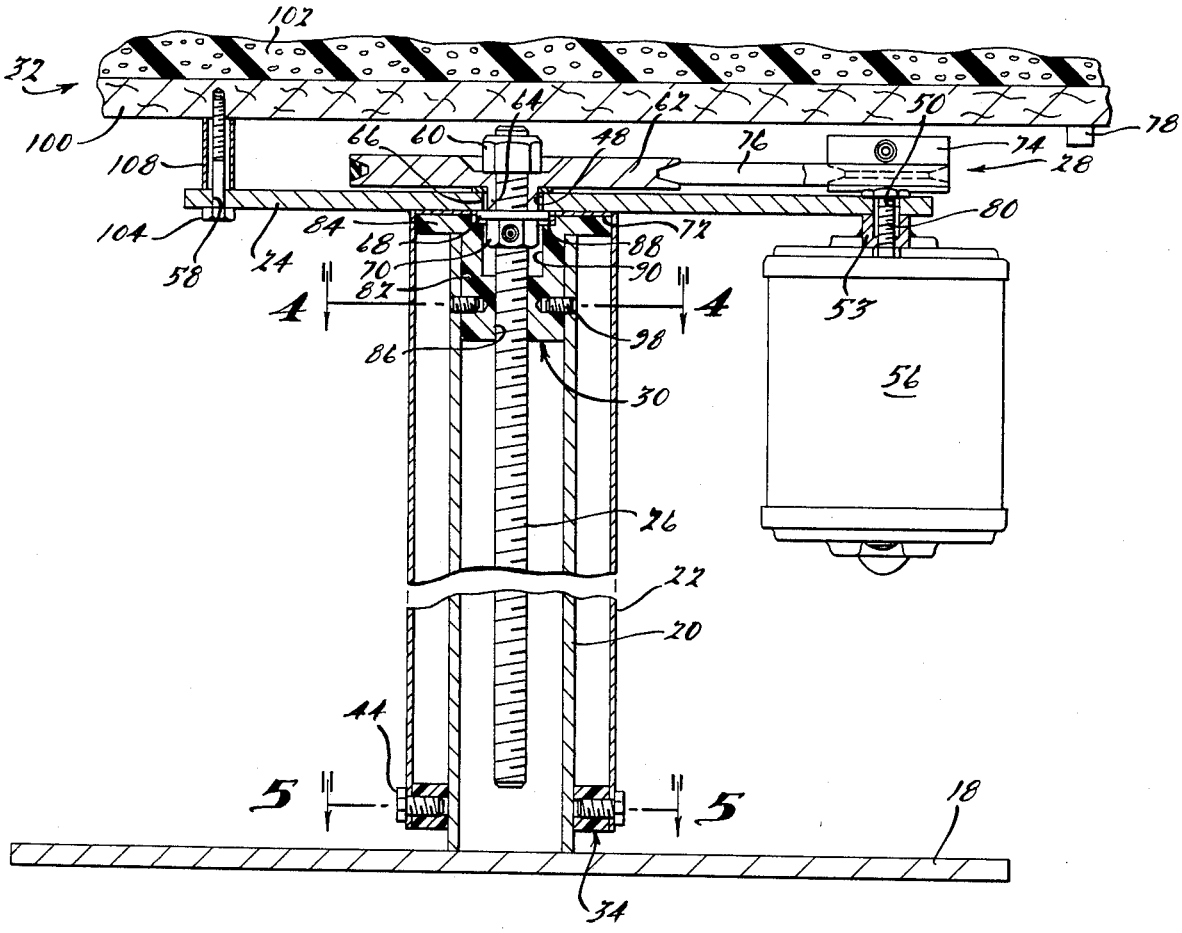
FIG. 3 is a partial vertical cross-sectional view of the V-berth platform of FIG. 2 taken generally along line 3—3 therein.

Turning to FIG. 3, V-berth platform 10 includes a base member 18 having a vertically extending column member 20 affixed thereto. An elongated tubular member 22, extending from a plate member 24, is slidably supported on the column member 20. A power screw 26, rotatably secured to plate member 24, is rotatably coupled with support member 22. A drive mechanism 28 is coupled with power screw 26 for rotating it in either a clockwise or a counterclockwise direction. A nut member 30, coupled with column member 20 and power screw 26, converts the rotational movement of power screw 26 into vertical movement of the power screw 26. V-berth platform 10 also has a cushion structure 32 for providing the V-berth with a continuous cushion in the cut away portion 12, when the platform 100 is in its upper position.

Figure 2:
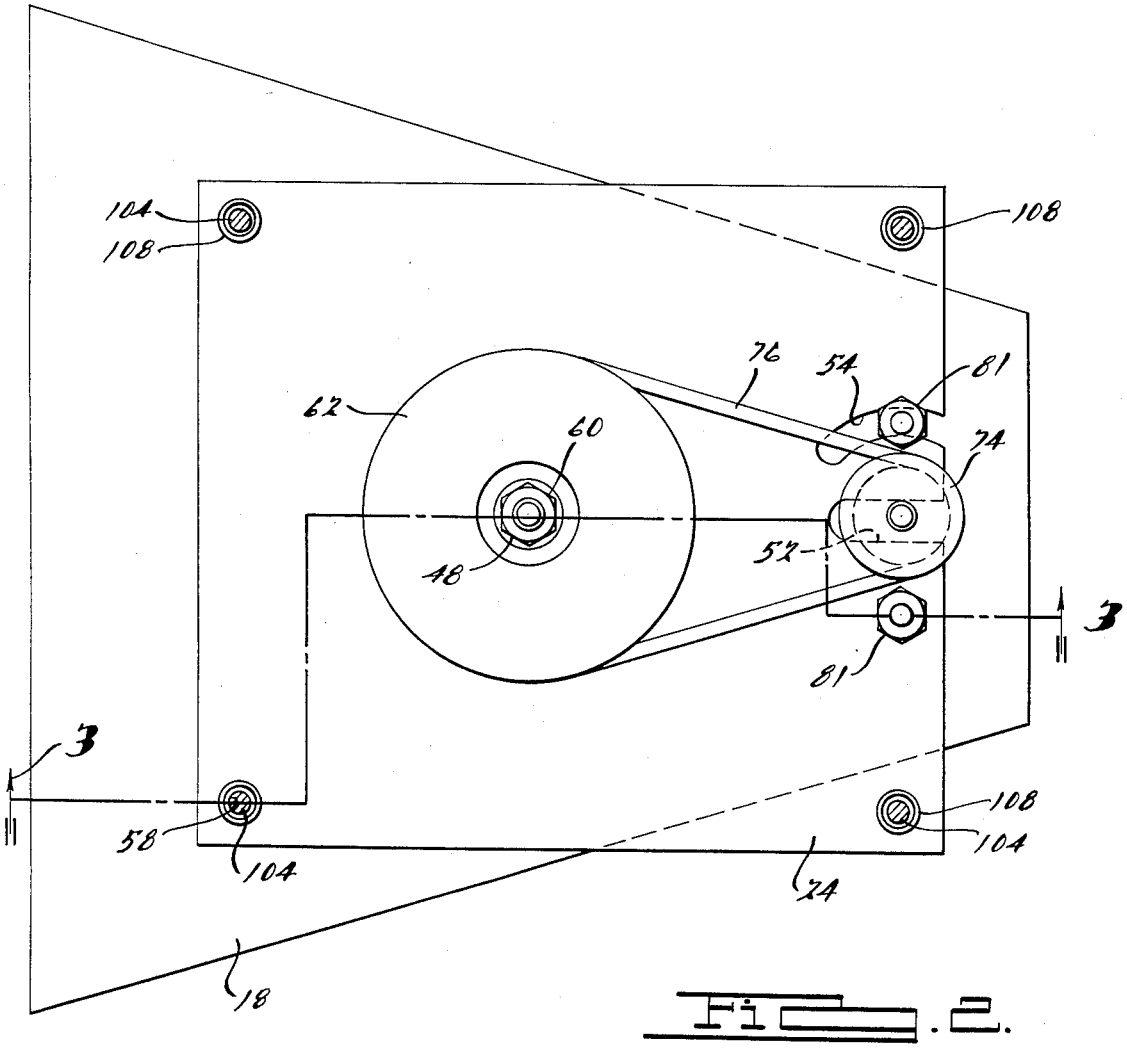
FIG. 2 is a top plan view of the apparatus of the present invention with the cushions structure removed.

Base member 18 may be fabricated from aluminum plate and is preferably of a trapezoidal shape, as best seen in FIG. 2. The trapezoidal design enables the V-berth platform 10 to fit snugly in the V-berth compartment of the vessel 16. Column member 20, an elongated preferably aluminum tube, is fixedly secured to the base member 18 by conventional means, such as by welding. Tubular member 22 is secured to plate member 24, which may be formed from aluminum plate, by conventional means, such as by welding. Generally, the elongated tubular member 22, which may also be formed of aluminum, is circular in cross section and slidably surrounds column member 20.

Figure 5:
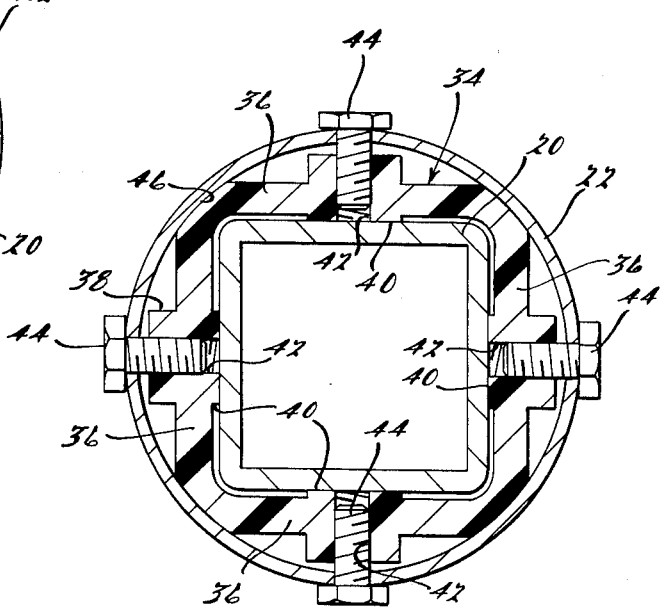
FIG. 5 is a cross-sectional view taken along line 5—5 in FIG. 3.

Tubular member 22 is provided with a guide member 34 on the inside of the free depending end thereof for guiding tubular member 22 as it slides on column member 20. Guide member 34, best seen in FIGS. 3 and 5, has an overall rectangular shape and is preferably formed of a plastic or polymeric material. The guide member 34 is comprised of four side walls 36 each having an outer boss 38 and an inner aligned boss 40 formed therein. Boss 40 projects from the interior of wall 36 and slidably abuts column member 20. Guide member 36 has rounded exterior corners 46 to provide for accurate location in tubular member 22. Guide member 34 is held in place by means of four bolts 44 extending through tubular member 22 and threadably engaging threaded holes 42 extending through side walls 36 where bosses 38 and 40 are located. The bolts are adjusted so that bosses 40 just slightly clear the adjacent wall of column member 20, thus providing minimum sliding clearance. As tubular member 22 slides up and down on column member 20, guide 34 improves the lateral stability of the assembly and virtually eliminates rocking or tilting between support member 20 and column member 22.

Power screw 26 is threadably secured adjacent its upper end to a pulley 62 having a collar 64 provided in a bushing 66 disposed in an opening 48 in plate 24. A lock nut 60 and a set screw retained nut 70, along with washer 68, prevent power screw 26 from moving axially relative to plate 24. A resilient stop 72 is positioned on the underside of plate member 24, within tubular member 22, for cushioning the contact between nut member 30 and plate member 24.

The drive mechanism 28 includes, in addition to pulley 62 coupled to power screw 26, a pulley 74 coupled to an electric motor 56, and a V-belt 76 drivably interconnecting pulleys 62 and 74. Motor 56 is a conventional reversible motor and is activated by a three position switch 78 which may be affixed to the underside edge of cushion assembly 32. The motor is secured to plate 24 by a pair of threaded studs 80 affixed to the upper end surface of the motor. One stud extends through a circular hole 50 in plate 24 and the other stud through an arcuate opening 54 in plate 24, the center of curvature of opening 54 being the center of hole 50. Each stud 80 has a spacing sleeve 53 on the underside of plate 24 and a nut 81 on the top side of plate 24. The motor is affixed in place by swinging it clockwise as shown in FIG. 2 until V-belt 76 is tight enough, and thus tightening nuts 81.

Figure 4:
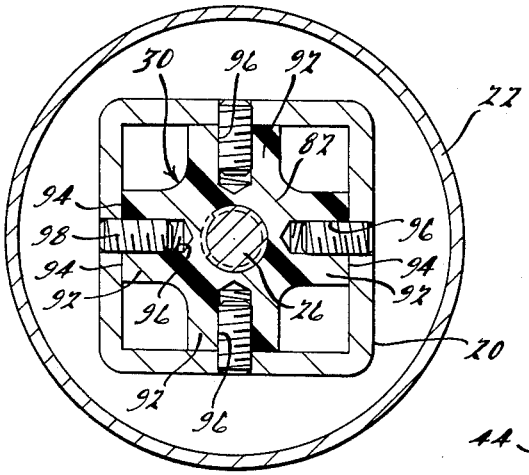
FIG. 4 is a cross-sectional view taken along line 4—4 in FIG. 3.

Nut member 30, best seen in FIGS. 3 and 4, is preferably formed from a plastic polymeric material and comprises a body portion 82 and a peripheral flange portion 84 (FIG. 3). A threaded central bore 86 extends centrally through body portion 82 and has power screw 26 threadably disposed therein. Nut member 30 converts rotational movement of the power screw 26 into vertical movement of power screw 26, plate member 24 and cushion assembly 32. Body portion 82 has four circumferentially spaced ribs 92 (FIG. 4) each having planar outer surfaces 94 abutting against the interior walls of column member 20. Ribs 92 each have an aperture 96 for receiving a threaded set screw 98 to secure nut member 30 to column member 20. Flange portion 84 is preferably circular and slidably engages and is guided by the inside surface of tubular member 22 as the assembly moves upwardly and downwardly.

Cushion assembly 32 comprises a planar support 100 formed out of wood or any other desired material, and a foam mattress 102. Support 100 is secured to plate member 24 by conventional means, such as by four bolts or screws 104 extending through holes 58 in plate 24, and is maintained in a spaced relationship with respect to plate 24 by spaces 108. Foam mattress 102 is preferably comprised of the same material as that of the mattress of the V-berth bed 14 and the entire cushion assembly is of a trapazoidal shape, in plan, so that it fills the gap in the V-berths when the assembly is in its raised position. When in its lowered position the assembly provides an ideal stool or seat, as well as access to the storage cupboards under the V-berths.

While it will be apparent that the preferred embodiment of the inventions is well calculated to provide the achievements and features above stated, it will also be appreciated that the present invention is susceptible to modification, variation, alteration and change without departing from the proper scope or fair meaning of the subjoined claims.

I claim:

1. A powered platform for use in combination with a conventional V-berth comprising:

(a) a generally horizontal, flat, cushion element having a shape in plan substantially corresponding to that of the gap in the V-berth;

(b) a vertically extending support structure supporting said cushion element for movement between a lowered seating position and a raised sleeping position in which it is substantially flush with said V-berth; and (c) powered drive means for moving said support structure between said two positions.

2. The powered platform according to claim 1, wherein said support structure includes a first generally vertically extending tubular member fixed in position, and a second tubular member in telescoping relationship therewith and affixed to said cushion element.

3. The powered platform according to claim 2, wherein said first tubular member is disposed within said second tubular member.

4. The powered platform according to claim 2, wherein said drive means includes a powered drive screw disposed within said tubular members and a drive nut threadably engaging said screw, said screw being affixed to one of said tubular members for rotation with respect thereto and said nut being non-rotatively affixed to the other of said members.

5. The powered platform according to claim 4, wherein said drive nut is affixed to said first tubular member.

6. The powered platform according to claim 5, wherein said drive means further includes an electric motor for rotating said drive screw.

7. The powered platform according to claim 6, wherein said electric motor is mounted on the underside of said cushion element.

8. The powered platform according to claim 2, further comprising first guide means disposed at one end of said first tubular member, and adapted to slidingly engage said second tubular member.

9. The powered platform according to claim 8, further comprising second guide means disposed at one end of said second tubular member and adapted to slidingly engage said first tubular member.

10. The powered platform according to claim 2, further comprising second guide means disposed at one end of said second tubular member and adapted to slidingly engage said first tubular member.

11. The powered platform according to claim 2, wherein said first tubular member is non-circular in cross-section andis disposed within said second tubular member.

12. The powered platform according to claim 11, further comprising guide means disposed inside and adjacent the lower end of said second tubular member, said guide means being affixed to such second tubular member and having a guiding surface slidably engaging the outside surface of said first tubular member.

13. The powered platform according to claim 12, further comprising at least one threaded fastener for affixing said guide means to said second tubular member, adjustment of said fastener being operable to vary the position of said guiding surface with respect to the outside surface of said first tubular member.

14. A powerized V-berth platform for a boat, yacht, or the like, comprising:

a base member disposed on the floor of the boat;

an elongated support member extending vertically from said base member;

a plate member having a depending elongated tubular member slidably positioned around the outside periphery of said support member;

power screw means rotatably secured to said plate member, said power screw means rotatably coupled with said elongated support member;

drive means coupled with said power screw means for rotating said power screw in a clockwise or counterclockwise direction;

means associated with said elongated support member and coupled with said power screw means for converting said power screw rotation into a vertical raising and lowering of said power screw means and plate member with respect to said support member; and cushion means having a shape that readily fits into the cut away portion of a V-berth disposed on said plate member whereby said V-berth platform is movable to and from a lowered position in which it can be utilized as a seat and an upper position in which it can be utilized to fill in the cut away portion of the V-berth.

* * * * *